United States Patent [19]

Waas et al.

[11] Patent Number: 4,506,617

[45] Date of Patent: Mar. 26, 1985

[54] SHIP

[75] Inventors: Heinrich Waas, Bonn; Ayres Freitas, Emden; Jürgen Schultz, Leer; Günter Varges, Emden, all of Fed. Rep. of Germany

[73] Assignee: Thyssen Nordseewerke GmbH, Emden, Fed. Rep. of Germany

[21] Appl. No.: 438,056

[22] Filed: Nov. 1, 1982

[30] Foreign Application Priority Data

| | | | |
|---|---|---|---|
| Nov. 5, 1981 | [DE] | Fed. Rep. of Germany | 3143857 |
| Feb. 3, 1982 | [DE] | Fed. Rep. of Germany | 3203468 |
| Jun. 11, 1982 | [DE] | Fed. Rep. of Germany | 3221924 |
| Sep. 11, 1982 | [DE] | Fed. Rep. of Germany | 3233816 |

[51] Int. Cl.[3] ..... B63B 35/08

[52] U.S. Cl. ..... 114/41; 114/56

[58] Field of Search ..... 114/40–43, 114/56–57

[56] References Cited

U.S. PATENT DOCUMENTS

| | | | |
|---|---|---|---|
| 2,191,904 | 2/1940 | Baker | 114/56 |
| 3,706,295 | 12/1972 | Iozza | 114/41 |
| 3,727,571 | 4/1973 | Devine | 114/41 |
| 3,931,780 | 1/1976 | Waas | 114/41 |

FOREIGN PATENT DOCUMENTS

| | | | |
|---|---|---|---|
| 2823074 | 11/1979 | Fed. Rep. of Germany | 114/40 |
| 911740 | 7/1946 | France | 114/56 |

*Primary Examiner*—Trygve M. Blix
*Assistant Examiner*—Jesûs D. Sotelo
*Attorney, Agent, or Firm*—Toren, McGeady, Stanger, Goldberg & Kiel

[57] ABSTRACT

The prow of the ship with a lower power requirement in open and ice-covered water has a front surface which is forwardly inclined at the top over the entire beam of the ship with marginal cutting edges, preferably on rod-like profiles. The front surface passes into an underwater prow part with frames which are V-shaped at the bottom. The cutting edges above the waterline can forwardly pass into two catamaran-like stems, the front surface being curved in the longitudinal direction. The front surface is carried by thwartships frames, which are horizontal at the bottom in the central part of its longitudinal extension, below the construction waterline and approximately forms a plane there. In the midships longitudinal direction an ice-cutting central skid is provided on the prow. Even in the case of widely varying ice characteristics, favorable conditions are provided for breaking out one-part ice floes. The one-part ice floes are split up underwater centrally into two halves floating laterally under the fixed ice layer, which largely prevents crushing into a large number of pieces.

22 Claims, 12 Drawing Figures

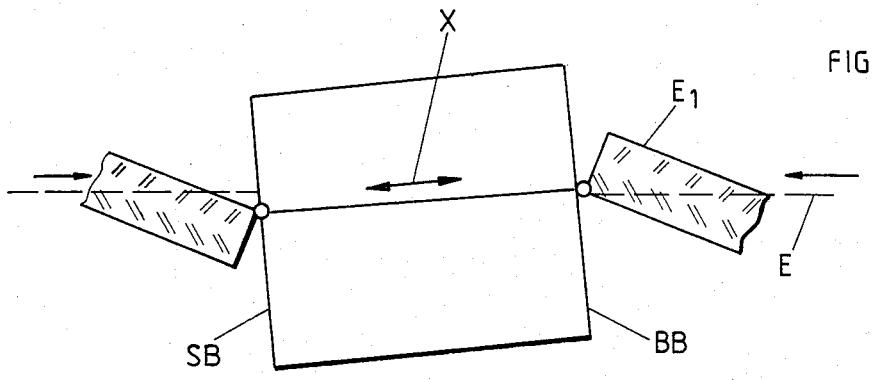
FIG. 2
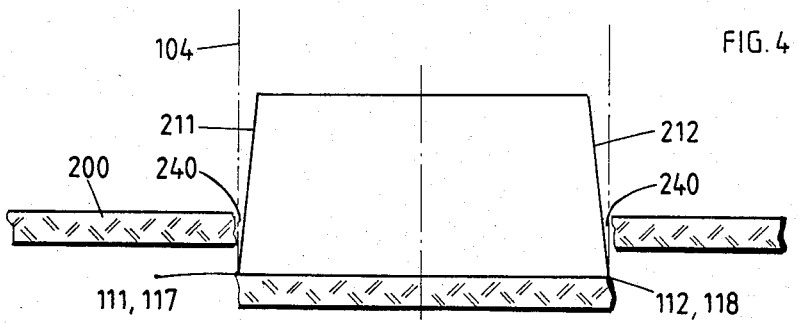
FIG. 4
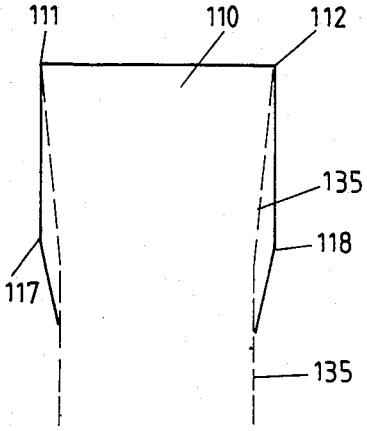
FIG. 5
FIG. 6
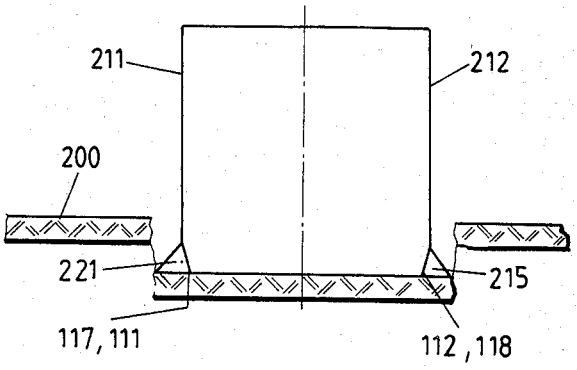

SHIP

BACKGROUND OF THE INVENTION

The invention relates to a ship with a prow.

In order to reduce the power required for the propulsion of ships and in order to save fuel, the various technical solutions have been proposed. Thus, it is known e.g. from German Pat. No. 1,207,820 to improve the flow to the propeller and consequently the propulsion efficiency by an asymmetrical construction of the stern. In the case of a hull for a single-propeller ship or a ship with a central propeller with a low Froude number and correspondingly high volumetric efficiency, the shape of the stern is made asymmetrical in such a way that that part of the stern above the propeller shaft is turned compared with that part of the stern located below the shaft counter to the rotation direction of the propeller and consequently in the vicinity of the propeller race, the axes of the horizontal sections through the hull are inclined away from the median longitudinal plane of the ship counter to the rotation direction of the propeller and namely so as to increase from that of the root of the propeller blades to the area facing the ends of the blades, so that viewed from aft, the propeller post forms with the median longitudinal plane above the propeller shaft an angle inclined counter to the rotation direction of the propeller.

This shape has mainly been developed for full-built ships in order to improve the flow against the propeller and in order to increase the stern fineness compared with symmetrical sterns, without any loss of propeller efficiency. Whilst retaining the original fineness or displacement of the stern, it is possible to obtain, as required, a speed increase or, for the same speed, a reduction of the propulsive output and consequently fuel consumption.

Output and/or fuel savings have been achieved in the case of various ships having such sterns. In the case of these ships, that part of the stern located above the propeller shaft has been turned counter to the rotation direction of the propeller compared with the part below the shaft and as a result of a conventional U-shaped frame below the propeller shaft, a configuration of the isotach of the wake in this area has been achieved, which is very close to the ideal case of rotational symmetry. These ships have coefficients of fineness between appoximately 0.75 and 0.83. In the case of relatively faster ships in the range of higher Froude numbers and lower volumetric efficiencies, it is known to favourably influence the course of the isotach of the wake by providing stern reinforcements.

The use of maximum propeller diameters with correspondingly low speeds is often sought for economic reasons, because this can lead to an efficiency improvement and to a reduction in the required power or fuel consumption. However, it has been found that in the case of extremely large propeller diameters compared with the draught, the wake conditions deteriorate and vibration-exciting forces and cavitation occur, so that as a function of the type of ship, the fineness and the speed, special additional technical means must be provided for obviating these disadvantages, which are disadvantageous from the economic standpoint.

In addition, a ship with ice-breaking characteristics is known, whose hull is provided with a pontoon-shaped prow part above the waterline with a front surface extending over the entire beam and which in its lower part slopes upwards and forwards in a pronounced manner and with approximately parallel sectional areas on the lower edges of the side walls. The part of the underwater prow following onto the pontoon-shaped prow part is V-shaped and with laterally upwardly and forwardly inclined transition surfaces abutting with a forwardly inclined stem passes into the pontoon-shaped prow part (German Pat. No. 2,343,719).

If a ship constructed in this way passes through a layer of ice, it has been found that in the latter a channel with smooth straight edges is formed and the width of this channel corresponds to the width of the ice breaker. However, during the ice breaking process, undesired, disadvantageous phenomena can occur. Thus, in the case of a ship according to German Pat. No. 2,343,719 the parallel prow sides above the cutting edges lead to a frictional force being exerted but the cut ice surface on the outer plating of the ship, causing a not inconsiderable proportion of the resistance of the latter in the ice. Furthermore, when the hull is listing, this frictional force can be increased through the waterline width of the listing ship being increased compared with the cut channel in the ice, so that a squeezing or jamming effect is produced.

This squeezing effect is increased if the layer of ice is subject to horizintal stresses at right angles to the direction of travel, so that ice pressure on the sides is increased. This leads to an effect of forces according to FIG. 2, in which the pressure direction is X, the starboard side of the cross-sectionally diagrammatically indicated hull is SB, the port side is BB, the layer of ice with horizontal compressive force is E1 and the layer of ice without compressive force is E, which leads to a bending process in the ice layer/ice breaker/ice layer system, considered in the action line at right angles to the direction of movement. On the port side, this leads to a raising of the ice layer and ice breaker, but to a lowering on the starboard side. As in any bending process, there can be an interchange between the rising and lowering motions. The greater these pressures, the greater the list and friction.

According to German Pat. No. 2,530,103, an ice breaker with a pontoon-shaped prow part above the waterline is constructed in such a way that said prow part has sliding and breaking profiles on the lower edges of its two side walls, which are parallel to one another and extend up to the V-shaped part of the underwater prow. The facing wall faces of these profiles slope upwards and carry the cutting edges.

Such an ice breaker with planar, upwardly sloping faces of its pontoon-shaped prow slides on the ice to be broken without the central part of the prow coming into contact with the ice. As a result of the forces exerted on the ice by the two cutting edges, a single-part ice floe is broken and essentially has the same width as the prow. Finally, at the sharply upwardly directed underwater stem, which essentially forms an extended keel in the vicinity of the V-shaped underwater prow, this ice floe due to its buoyancy passes into an unstable state of equilibrium, from which the floe is tilted to one side and floats laterally under the fixed ice layer, to give an ice-free channel.

It has been found that in the case of such an ice breaker, improvements are necessary in connection with the reliable guidance of this ship when sliding onto the fixed ice layer and in connection with the following shear fracture behaviour with highly fissured ice surfaces, such as pack ice ridges which have frozen onto one another, and under different and optionally varying ice conditions, such as strength, thickness, etc. A ship according to German Pat. Nos. 2,343,719 and 2,530,103 has the disadvantage that the broken ice floes with the complete ship's beam can float in uncontrolled manner to any side, but often do not completely disappear beneath the unbroken ice layer or are broken into a larger or smaller number of fragments by uncontrollable crushing operations, which can also not be passed laterally under the fixed ice layer. When travelling in ice-free areas, the ship is subject to considerable, damaging buffeting by the sea.

DOS No. 2,112,334 discloses an ice breaker, whose hull passes into an underwater prow with two wedge-shaped ice breaker stems forming between them a channel. At the rear end of the channel, a snowplough-like guidance means is arranged beneath the bottom of the ship. The resulting large number of small ice floes cannot be passed under the lateral, fixed ice layer and instead float in the gap between the hull and the lateral fixed ice layer, causing increased friction on the outer plating of the ship, or they collect in the channel and slide midships under the ship into the propeller area. Thus, such a ship has increased power requirements and the propellers are exposed to the harmful action of ice floes.

It is also known that ships, particularly ice breakers, with pontoon-like prow part when travelling in ice-free, open water are subject to severe buffeting by the waves striking the bow, leading to considerable vibrations on the hull, which makes it difficult to maintain course and increased power is needed for propulsion purposes.

BRIEF SUMMARY OF THE INVENTION

The invention solves the problem of providing a ship with a reduced power requirement or propulsion without great technical and constructional expenditure and effort and in particular having ice-breaking characteristics. The disadvantages of known ice breakers are avoided and in particular the conditions for the shear fracture of a one-part ice floe from the fixed ice layer are made more favourable and the guidance of the floe under water is improved with reduced risk of the floe being crushed into a large number of fragments and as a result of the floe can be more reliably brought under the fixed ice layer. In addition, in the case of ice-going ships having a pontoon-like prow, only simple means are required for reducing the bow wave action, so that such ships can travel in open water in power saving manner, without being buffeted by bow waves.

The present invention therefore relates to a ship with a prow, wherein the prow of the ship has a front surface extending over a considerable part of the beam and which is inclined downwardly and rearwardly and is bounded at its outer lateral borders by two longitudinally, partially curved lateral edges, whereby the lateral edges project laterally with respect to the overlying hull and the front surface is increasingly downwardly curved or bent thwartships from front to rear.

It has surprisingly been found that a ship with the prow constructed in this way requires less power for propulsion purposes, which leads to superiority compared with conventional ships, which require more power for the same speed. In addition, the reduced power requirement for propulsion is achieved as a result of a simple, economic, constructional development, so that it is even possible to reequip existing hulls.

According to a further development of the invention according to claim 2, in the case of an ice breaker a constructional development is provided, according to which the cutting edges form the widest part of the hull coming into contact with the ice.

In the case of such a moving ice breaker, it is possible to construct a gap between the hull and the ice, which prevents a horizontal force transfer, as shown in FIG. 2. The gap increases upwards, but can also increase rearwards. The special prow construction is particularly advantageous, because when the ice breaker is operating, it is immediately ensured that when the lower edges of the side walls of the prow cut into the ice, as the ice breaker advances a gap is formed between the latter and the fixed ice layer. As a result, no further forces can form between the ice layer and the side wall of the ice breaker. Frictional forces cannot occur in this way, because there is no listing process.

Claim 3 relates to a construction of an ice breaker, wherein the cutting edges and the inclined front surface at the top are constructed in longitudinally curved manner, the front surface in the middle area of its longitudinal extension close to and particularly below the construction waterline has approximately horizontal, thwartships-disposed lower limitations of the frame, which at least approximately form a plane, and on the underwater prow in the midships longitudinal plane is provided a skid with an ice-cutting profile.

This construction ensures that the cutting of the ice surface takes place very effectively under the aforementioned differing ice conditions, because optimum conditions are provided for the lateral shear fracture of the ice floe and bending break in the transverse direction thereof.

The broken, one-part ice floe, unlike in the case of known ice breakers, is not guided onto a steep underwater stem at the rear end of the front surface which is forwardly inclined at the top and which presses the ice floe downwards, leading to an unstable state of equilibrium. It has been found that a stem acting in the manner of a sweeping wedge in the V-frame area can lead to a crushing of the one-part ice floe approaching from the front, so that numerous fragments float in the travel channel. One-part ice floes broken from the fixed ice layer and frequently having a high brittleness and/or surface cracks are subject to the risk that in the case of suddenly occurring, uncontrolled loading, i.e. in the unstable state of equilibrium on the underwater stem due to the two-sided buoyant forces on the two floe edges, can be broken in energy-dissipating manner into small pieces as a result of a blow from the stem or to striking against the ship's hull. With the central skid located in the midships longitudinal plane, the ice floe is centrally scratched or notched and a desired breaking line is formed and as a result the one-part floe is subdivided by the buoyant forces into two approximately equally large parts, which then float laterally under the ice layer. Due to the cross-section, longitudinal extension and longitudinal shape of the central skid, there are gradual transitions at the different sloping surfaces and edges of the underwater prow. The notch effect can be gradually increased, so that the sought central bipartitioning of the break-prone ice floes is largely ensured.

Further, advantageous developments of the invention can be gathered from the subclaims. The reliably guided running up of the ship and the cutting of floes from ice layers with fissured and height-variable surfaces can be further improved in that the cutting edges pass at the front and top into two catamaran-like stems, with respect to which the ship is set back in the vicinity of the midships longitudinal plane and rises more steeply upwards than the two stems. Since, as a result of the catamaran-like construction of the prow, the underside of the ship is inwardly upwardly curved, the two lateral cutting edges lead to an undisturbed two-point or two-line support of the prow aiding the sought shear break, even in the case of irregular resistant ice formations, such as ridges, so that the vertical, ice-breaking centrifugal action acts fully on the two lateral cutting edges. Any contact between the ice and the hull between the two cutting edges is largely avoided, even in the case of fissured ice surfaces. A multiple contact or support of the forwardly inclined front surface at the top of the ice would lead to sloping or lateral force components, which would unfavourably influence or prevent the necessary shear break of the ice layer. This abovewater prow shape also leads to a particularly calm and continuous travel of the ship in the sea, without impairing the ice-breaking characteristics.

The cutting edges are preferably located on rod-like profiles and are directed forwards over and beyond the front surface into the area of the two catamaran-like stems above the strong ice waterline, in order to provide favourable conditions for cutting the ice floes, even in the case of very thick ice.

The central skid is preferably arranged in the rear underwater area of the front surface. The profile height of the central skid can rearwardly slightly increase, so that the lower edge thereof is only slightly more inclined with respect to the horizontal than the lateral cutting edges. As a result, theinitial central notching of the ice floe takes place very carefully. As a function of the expected ice conditions, the central skid need only be arranged in the underwater prow part with V-shaped frames.

However, the central skid is advantageously usually arranged in such a way that it starts in the rear underwater area of the sloping front surface and extends rearwards up to the ship's bottom. The central skid can be curved for optimum cooperation with the two lateral cutting edges and for adapting to the ice conditions expected by the ship. The central skid can also at least partly be formed by a tooth profile.

The lateral cutting edges preferably located on rod-like profiles are generally continued rearwards into the bottom-V-shaped part of the underwater bow, being extended even further rearwards when resistant ice formations are expected. It is advantageous for the careful production of the central desired breaking line in the ice floe, if the central skid initially projects slightly downwards in its front skid area compared with the sloping front surface of the prow or the surface fixed by the two lateral cutting edges on the rod-like profiles, then gradually increasingly projects rearwards and then projects to a lesser extent again. The two lateral skids formed from rod-like profiles with sharp cutting edges appropriately pass at their rear end into bulge-like lateral thickened portions of the hull, so that the two halves of the originally one-part ice floe obtained as a result of the desired breaking line produced, can slide laterally outwards at the sloping faces of the ship and without any risk of breaking at the edge of the ship can be diverted flat beneath the ice layer.

A ship with ice-breaking characteristics constructed in this way can ride lower in the water compared with the normal ice-breaking construction waterline as a result of heavier loading, i.e. with ballast water, in order to more easily break thicker ice layers. On sinking to a strong ice waterline, the essential characteristics of the ship are maintained unchanged, with the additional advantage that there is a higher bending moment for breaking the rectangular ice floes in bending break after shearing the lateral edges from the ice field.

A bow wave reduction in the case of ships with a pontoon-shaped prow is achieved in that the pontoon-shaped prow part of the ship has a plurality of nozzles extending from the port side hull wall to the starboard side hull wall, roughly in the vicinity of the construction waterline, through which in motion water, air or a mixture of water and air passes to the outside.

As a result of the nozzles located in the vicinity of the construction waterline in the prow part of a ship with a pontoon-shaped prow and through which water, air or a mixture of water and air passes to the outside in motion, it is possible to achieve bow wave reduction, so that the maintaining of the ship's course is facilitated and no additional power is required for propulsion purposes. It has surprisingly been found that a ship with a pontoon-shaped prow part and with nozzles located in the vicinity thereof for the discharge of water or air leads to considerable advantages compared with those ships in which there is no nozzle system in the prow part area and which are therefore buffeted by the waves striking the bow, so that increased power must be used for maintaining course and for the propulsion of the ship. It has proved particularly advantageous to arrange nozzles below the construction waterline in the vicinity of the front faces of the pontoon-shaped prow.

BRIEF DESCRIPTION OF THE DRAWINGS

The invention is described in greater detail hereinafter relative to non-limitative embodiments and the attached drawings, wherein show:

FIG. 2 a diagrammatic view of the operation of an ice breaker with a prow constructed in per se known manner in conjunction with the effect of forces which occurs.

FIG. 4 the operation of a ship according to FIG. 3 in a cross-section in plane IV—IV thereof.

FIG. 5 a plan view of the prow.

FIG. 6 another embodiment of the prow in a cross-section in plane IV—IV of FIG. 3.

DETAILED DESCRIPTION OF THE PREFERRED EMBODIMENTS

Figure 1:
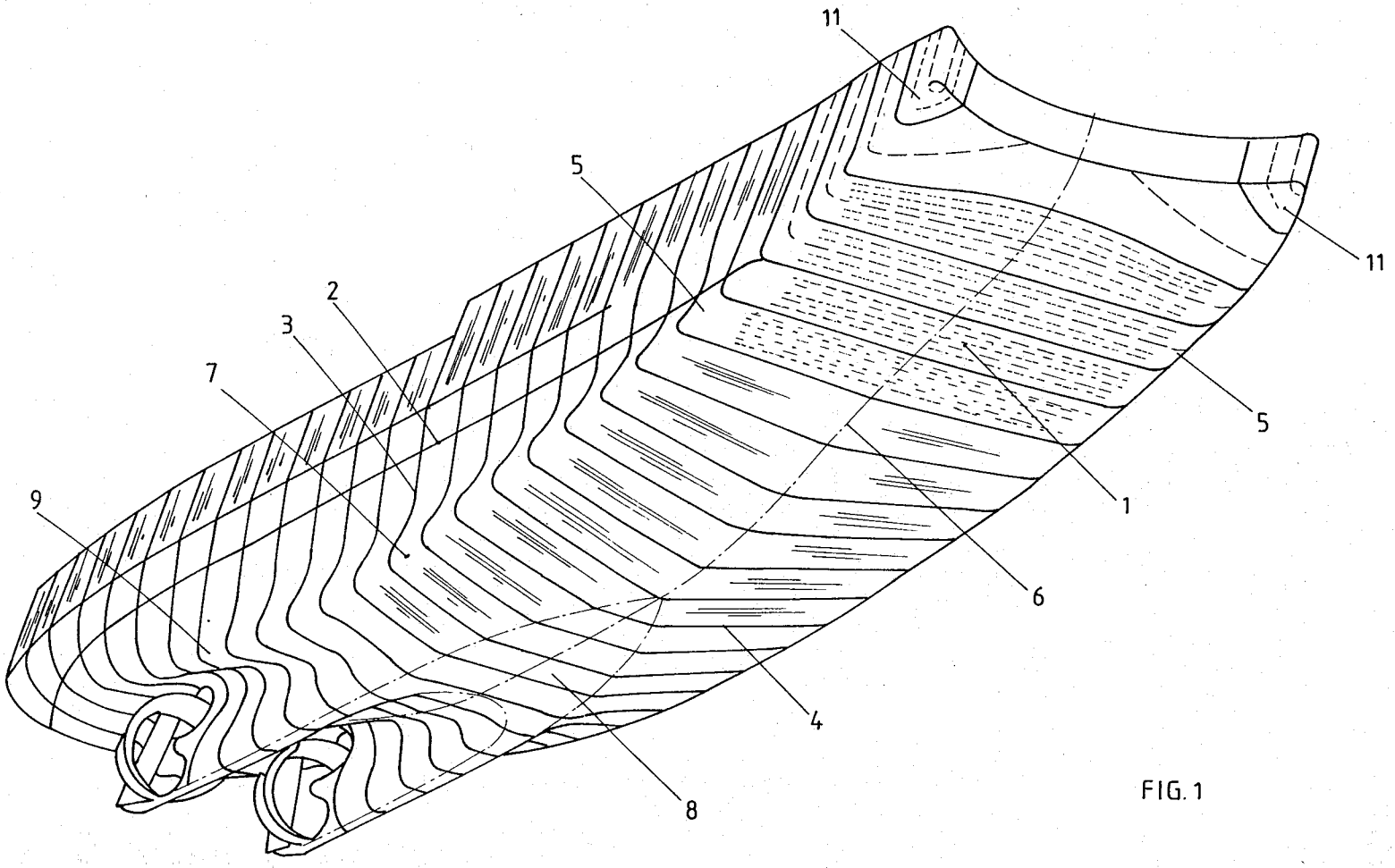
FIG. 1 a perspective view from below of a ship's hull with a pontoon-shaped prow.

The ship according to FIG. 1 has in the prow a front surface 1 sloping downwardly in the rearward direction over most of the beam. At its outer lateral borders, the front surface 1 is bounded by two longitudinally, partially curved lateral edges 5, which laterally project with respect to the overlying hull. Front surface 1 is increasingly thwartships curved or bent downwards from front to rear.

As can be gathered from FIG. 1, the underside of the frames 4 between the two lateral edges 5 is rearwardly decreasingly downwardly curved or bent thwartships from the point of the ship's length at which the front surface 1 reaches the ship's bottom 8 in the midships plane 6 up to at least the main frame plane 3.

The lateral edges 5 continue rearwards over a large part in the ship's length in the form of bulge-like reinforcements 7, which rearwardly issue into lateral boundaries of propeller tunnels, indicated at 9.

The lateral edges 5 are preferably rounded in cross-section, but can also be angular.

The front surface 1 can pass to the rear into an underwater prow part with V-shaped sloping frames at the bottom. In its end area, the front surface is centrally slightly bent and thus leads to a gradual and not excessively steep transition to the actual underwater part of the ship with downwardly V-shaped sloping frames. Towards the rear, the frames are trapezoidal and their contours are formed by bottom lines or by the ship's bottom 8 and following sloping side lines, which slope more than the preceding V-frames.

In the prow area, lateral edges 5 are at least partly below the construction waterline 2 in two lateral limiting planes parallel to the midships plane 6 in such a way that in all they describe the widest point of the underwater ship.

The front surface 1 has in the middle area a longitudinal extension close to and particularly below the construction waterline 2, approximately horizontal, thwartships, lower boundaries of the frames, so that in this area front surface 1 at least approximately forms a plane.

Lateral edges 5 are forwardly extended beyond front surface 1 above the construction waterline 2 and pass into two catamaran-like stems 11, with respect to which the ship is set back in the vicinity of the midships plane 6 and rises more steeply upwards than the two stems 11. At least above the longitudinal extension of lateral edges 5, the ship is formed by outwardly hollow or concave frames.

Figure 3:
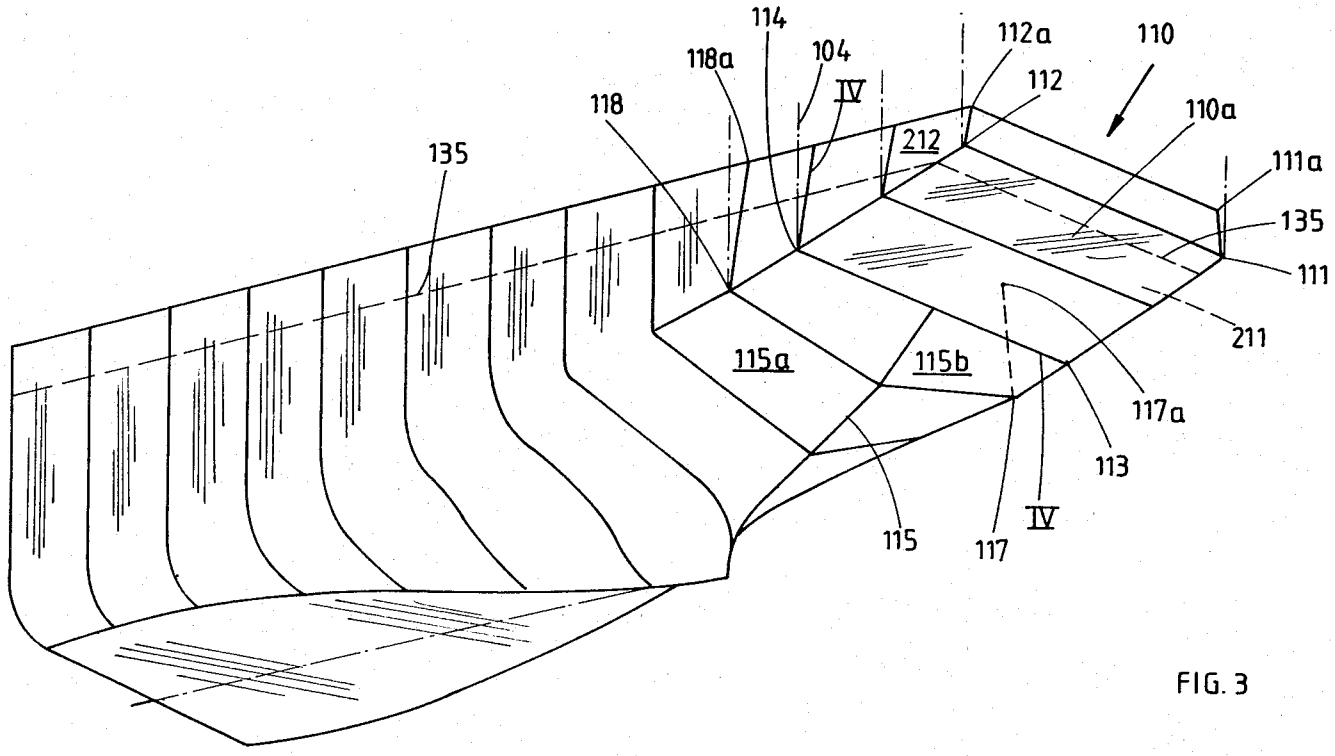
FIG. 3 a diagrammatic view from below of the prow of an ice breaker.

Prow 110 of an ice breaker has, according to FIG. 3, a pontoon-shaped prow part 110*a* and onto it follows a V-shaped part of the underwater prow. The front portion of prow part 110*a* has a downwardly inclined surface with corner points 111, 112, 113, 114, which is approximately flat and angular at the sides. The waterline is indicated at 135. The forwardly inclined surface of the prow passes below the waterline gradually into the V-shaped part of the underwater prow. The width of the prow part 110*a* is from the front to points 117, 118 greater than the remaining area of the ship coming into contact with the ice.

The V-shaped part of the underwater ship following onto the pontoon-shaped prow part 110*a* passes into the latter with laterally upwardly and inclined transition surfaces 115*a*, 115*b* abutting with an inclined stem 115. The side walls 211, 212 of prow part 110*a* are bounded by corner points 111, 111*a*, 117, 117*a* and 112, 112*a*, 118, 118*a*.

Side walls 211, 212 with their corner points 111, 111*a*, 117, 117*a* and 112, 112*a*, 118, 118*a* of the pontoon-shaped prow part 110*a* are constructed by lateral edges 111, 117 and 112, 118 so that they slope inwards and upwards to such an extent up to waterline 135, that the cutting edges project laterally beyond the underwater beam of the ship. The cutting edges form the widest part of the hull area coming into contact with the ice.

The ice breaker according to FIG. 3 can function as follows. Side wall 211 or 212 of prow part 110*a* inclined inwards from the perpendicular 104 leaves a gap 240 between the side wall and the fixed ice layer 200 (FIG. 4), which prevents horizontal force transfers as shown in FIG. 2. Gap 240 increases upwards, but can also increase rearwards, as shown in FIG. 5. The prow part is shown from above. In the case of particularly great ice pressure, it can be advantageous for the gap to increase from bottom to top and from front to rear. As a result, the friction between the fixed ice layer and the prow disappears even more rapidly.

In the embodiment of FIG. 6, the lower edges 111, 117 and 112, 118 of the prow part 110*a* assume the position shown in FIG. 4. The action obtained here is the same as in the embodiment of FIG. 4. However, manufacturing advantages are obtained. In addition, the embodiment according to FIG. 6 has a construction according to which the two side walls 211, 212 have at their lower edges outwardly projecting cutting profiles 215 or 221, which project laterally over and beyond the beam.

Figure 7:
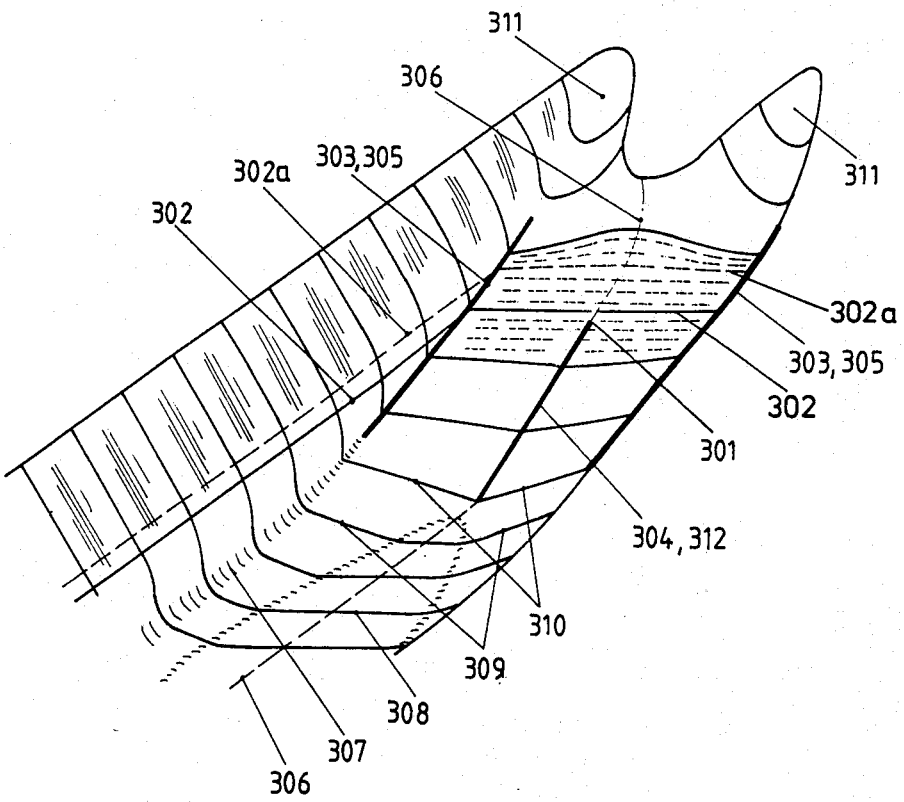
FIG. 7 a perspective view from below of the front part of the ship.
Figure 8:
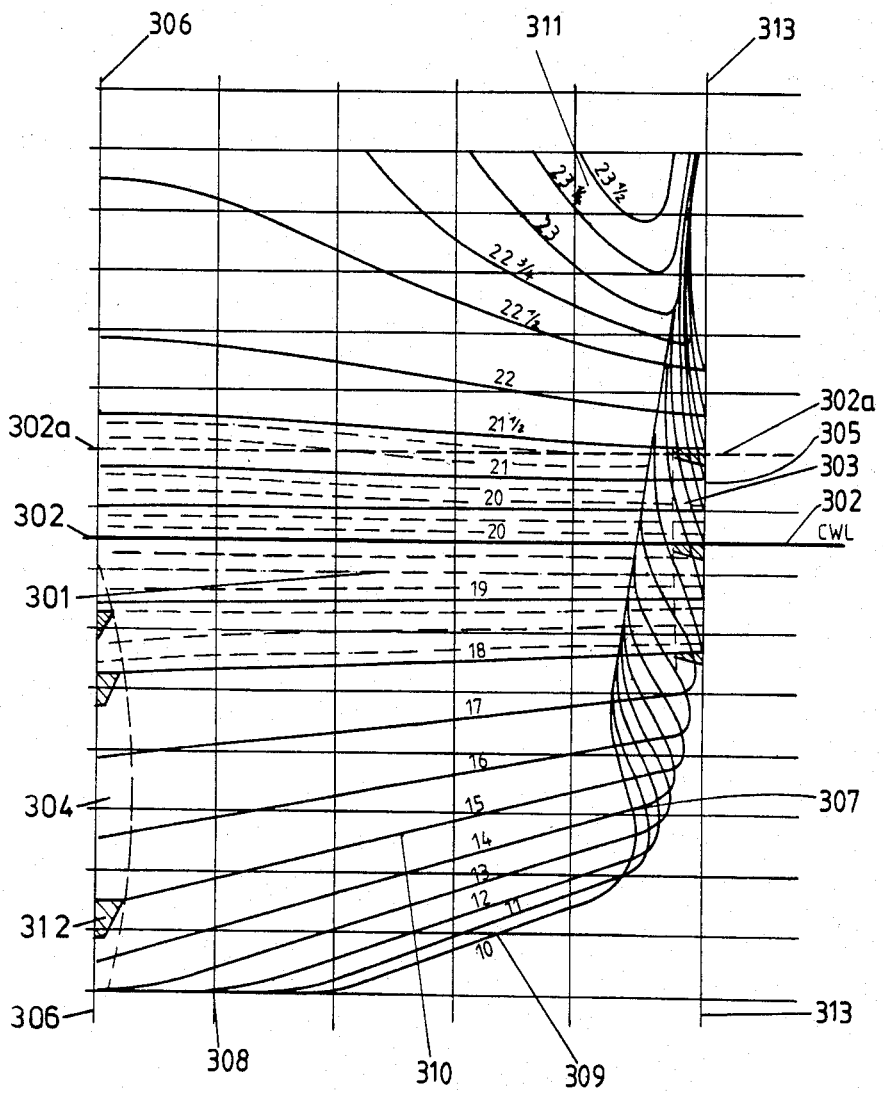
FIG. 8 a frame projection of the ship of FIG. 7.

An ice breaker has an inclined front surface 301 extending over the entire beam of the ship and indicated by dotted lines in FIGS. 7 and 8. Approximately half the longitudinal extension of front surface 301 extends below the construction waterline 302. At the two outer borders of front surface 301 there are cutting edges 305 extending in the longitudinal direction of the ship and which are arranged on rod-like sliding and breaking profiles 303 running symmetrically to the midships longitudinal plane 306 and hereinafter called longitudinal skids and which have two lateral limiting planes 313, which define the largest width of the ice breaking hull. Each lateral skid is slightly curved in its limiting plane 313. The forwardly inclined front surface 301 also follows this slight curvature in the longitudinal direction. In the central portion of its longitudinal extension and particularly below the construction waterline 302, front surface 301 has thwartships horizontal and substantially linear lower boundaries of the associated frames, so that they at least approximately form a plane there. Further forwards, front surface 301 is slightly upwardly curved in the transverse direction with a gradual adaptation to the prow, because at the top front the overwater prow passes into two catamaran-like stems 311, with respect to which the prow shape is set back in the vicinity of the midships longitudinal plane 306 and rises more steeply upwards than stems 311.

The inclined front surface 301 passes towards the rear into an underwater prow part with V-shaped sloping frames 310 at the bottom. In its end portion, it is consequently, centrally slightly bent and therefore leads to a gradual transition to the acutal underwater part of the ship with V-shaped sloping frames 310 at the bottom. Further aft, the frames have a trapezoidal shape, whose contours are formed by bottom lines 308 and then sloping side lines 309, which are more steeply sloped than the preceding V-frames 310.

As is particularly readily apparent from FIG. 8, the prow has the greatest beam corresponding to the spacing of the cutting edges 305 at the two lateral skids 303 (lateral boundary surfaces 313) over a length coinciding with the longitudinal extension of the two lateral skids 303, indicated by broken lines. The transverse lines indicated by dotted lines have a linear parallel configuration close to the construction waterline 302, where the front surface 301 is substantially a plane. Before this, it is slightly upwardly curved towards the centre, in the rear area centrally slightly bent and provided with the central skid 304. Compared with skids 303, 304 and the two stems 311, the remaining prow is definitely set back relative to the midships plane 306 at least in the area of its part coming into contact with the fixed ice layer or the just broken, one-part ice floe.

The central skid 304 in the midships longitudinal plane 306 extends from the rear underwater area of the planar front surface 301 over the underwater prow part with the lower V-shaped frames 310 and ends at the ship's bottom 308. Its longitudinal extension shown in FIG. 7 is indicated by broken lines in FIG. 8. Initially, profile 312 of central skid 304 has an approximately triangular configuration and subsequently a trapezoidal configuration with the apex downwards, so that a corresponding notch can be made in the one-part ice floe cut from the fixed ice layer and a desired breaking line is produced. The lower edge of the central skid 304 in the vicinity of front surface 301 slopes more with respect to the horizontal than the lower edge or cutting edge 305 of lateral skid 303. This slope difference relative to the horizontal decreases again rearwards. Thus, through the interaction between the profile height of the central skid and the height of the V-frames, the notch effect of the central skid can be chosen in an optimum manner, whilst taking account of the other construction conditions of the ship. This leads to a controlled, central bipartitioning of the approximately rectangular ice floe, whilst avoiding this floe being broken up into small pieces. In the rear area of the V-shaped underwater prow, the lateral skids 303 pass into bulge-like, lateral reinforcements 307 of the hull.

FIGS. 7 and 8 show a strong or thick ice waterline 302*a*, down to which the ship can be submerged, eg. by means of ballast water, so that a greater bending moment is available during the bending breaking of the approximately rectangular ice floe, sheared at its lateral edges, from the fixed ice layer, whilst the remaining characteristics of the ship are unchanged. The forwardly and upwardly inclined front surface 301 is almost completely under water.

Figure 9:
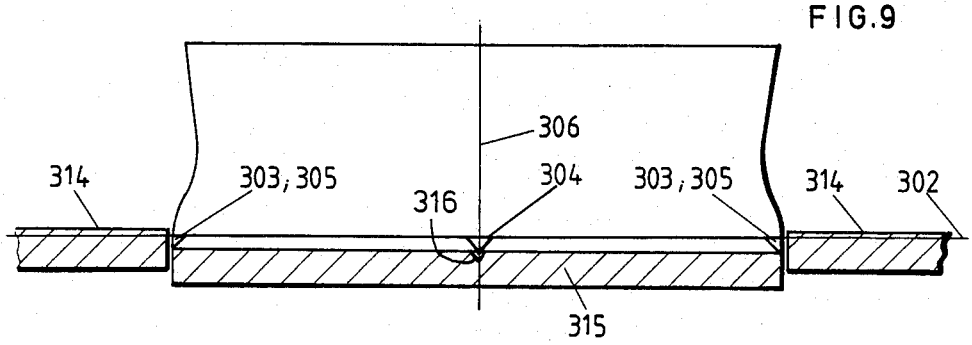
FIGS. 9 to 11 three different transverse planes of the ship illustrating the behaviour of the ice floe.
Figure 10:
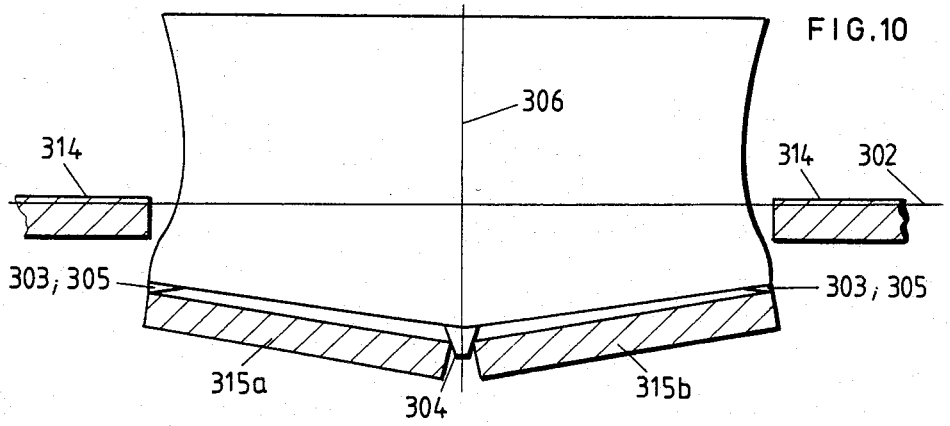
Figure 11:
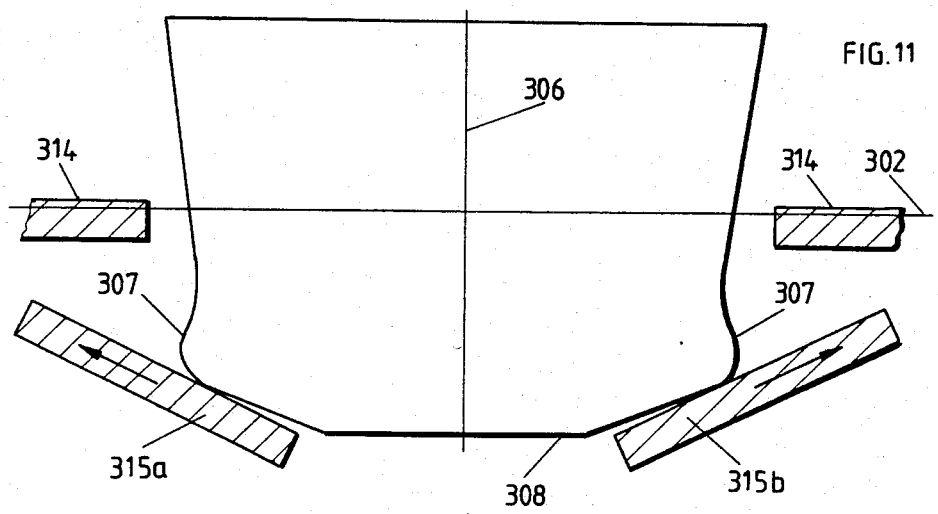

FIG. 9 shows the ice breaker in a cross-section behind the construction waterline 302 at front surface 301 (FIGS. 7 and 8) in the front portion of central skids 304. An ice floe 315 has been sheared on two sides from the fixed ice layer 314 under cutting edges 305 and is broken out in one part by a bending breaking operation at a not shown transverse line of the ice layer. The central skid 304 notches floe 315 centrally (notch indicated at 316) and forms a desired breaking line. In the underwater prow part with V-shaped frames at the bottom (cross-section according to FIG. 10), the central skid 304 and the lift at the floe edge, leads to the dividing up of the floe into two approximately equal halves 315*a*, 315*b*. At the further aft part of the ship (cross-section according to FIG. 11), these halves are guided laterally outwards beneath the fixed ice layer 314.

Figure 12:
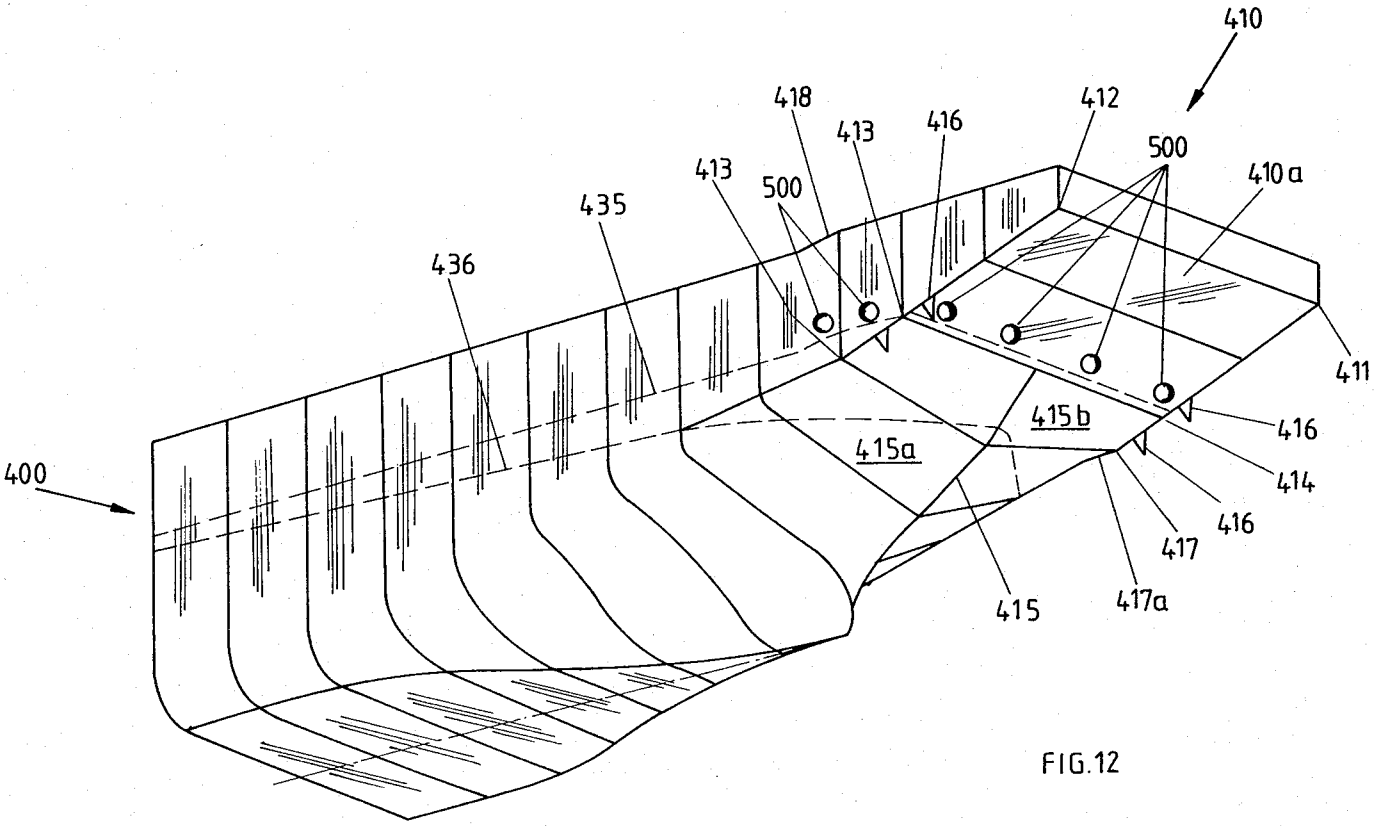
FIG. 12 a diagrammatic view from below of the pontoon-shaped prow of a ship with nozzles arranged therein.

Prow 410 of hull 400 of an ice breaker has, according to FIG. 12, a pontoon-shaped prow part 410*a*, which is followed by the V-shaped part of the underwater prow. Prow part 410*a* frontally comprises a strongly inclined surface with corner parts 411, 412, 413, 414, which is approximately flat above the waterline and angular at the sides. The action of the angular sides can be reinforced by sawteeth 416.

The sloping surface of the prow for a portion below the waterline gradually passes into the V-shaped part of the underwater prow. The width of prow part 410*a* is the same or even greater than the remainder of the ship from the front up to points 417 and 418. Following these points, the width of prow part 410*a* decreases with a definite step 417*a*, 418*a*.

The V-shaped part of the underwater ship following onto the pontoon-shaped prow part 410*a* of hull 400 passes with laterally upwardly and forwardly inclined transition surfaces 415*a*, 415*b* abutting with the forwardly inclined stem 415 into the prow part 410*a*.

The pontoon-shaped prow part 410*a* has a plurality of nozzles 500 extending from the port side hull wall to the starboard side hull wall in the vicinity of the construction waterline 435. When the ship is moving, water, air or a mixture of water and air passes to the outside through these nozzles by using appropriate devices. Preferably, the nozzles 500 are located below the construction waterline 435 in the vicinity of front surface 411, 412, 413, 414 of prow part 410*a*. Nozzles 500 are aligned in such a way that the water, air or water-air mixture passing out of the nozzles calms the bow waves striking the prow part.

Nozzles 500 are connected to or form part of single-nozzle systems constructed in per se known manner and provided on the hull side, said systems being constructed in such a way that their suction means can be kept ice-free, when the ship is in ice-covered waters and it is necessary to put into operation nozzles 500 located in the prow part of the hull.

What is claimed is:

1. A ship comprising a hull having a center keel and being elongated in the direction of the center keel and having a water line extending around the hull, a plurality of frames extending transversely of the center keel and said frames spaced apart in the elongated direction of said hull, said hull comprising a pontoon-shaped prow located above the waterline, said hull having side walls extending in the elongated direction thereof, said side walls in said pontoon-shaped prow extending parallel relative to one another, said pontoon-shaped prow having a downwardly facing front surface extending over the entire beam of said hull, said front surface has a flat portion and extends downwardly and rearwardly and meets said center keel below the waterline, wherein the improvement comprises a region of transition between said prow side walls and said front surface with said region of transition forming lateral edges extending in the elongated direction of said hull and projecting laterally outwardly from said prow side walls so that the distance between said lateral edges is greater than the distance between the upper edges of said prow side walls, said lateral edges projecting laterally outwardly for the maximum amount at a location spaced rearwardly from the flat portion of said front surface and said lateral edges having reduced outward projections from the maximum projection in the rearward direction of the hull, said hull having a bottom and said front surface meeting said bottom at a location spaced rearwardly from the flat portion of said front surface, said lateral edges of said prow side walls comprise cutting edges, said cutting edges are inclined downwardly from the front of said hull and are curved in the elongated direction of the hull, said front surface having an approximately horizontal portion below the waterline and said front surface rearwardly of said horizontal portion forming a skid extending along said center keel with said front surface sloping upwardly on both sides of said skid to the lateral edges thereof, so that said skid in said front surface defines an ice-breaking profile.

2. A ship, as set forth in claim 1, wherein said lateral edges are rounded.

3. A ship, as set forth in claim 1, wherein said lateral edges are sharp edged.

4. A ship, as set forth in claim 1, wherein said lateral edges comprise bulge-like reinforcements protruding laterally from the plane of said prow side walls.

5. A ship, as set forth in claim 4, wherein said hull forming propeller tunnels in the rear portion thereof and said bulge-like reinforcements combining with said propeller tunnels.

6. A ship, as set forth in claim 1, wherein said lateral edges are rounded in section transverse to said center keel.

7. A ship, as set forth in claim 1, wherein said front surface below the waterline and spaced centrally between said prow side walls has an approximately horizontal boundary for said frames located therein so that said front surface has a flat planar portion.

8. A ship, as set forth in claim 1, wherein said hull having a pair of laterally spaced stems at the front end of said hull and said lateral edges extend from said front surface above the waterline into said stems and said stems and said lateral edges located in said stems rise sharply upwardly.

9. A ship, as set forth in claim 1, wherein said side walls above said lateral edges have a concave shape.

10. A ship, as set forth in claim 1, wherein said side walls of said pontoon-shaped prow part extend upwardly and inwardly from said cutting edges at least up to the waterline of said hull.

11. A ship, as set forth in claim 10, wherein the angle of said side walls extending upwardly from said cutting edges increases in the direction from the front end to the rear end of the hull.

12. A ship, as set forth in claim 1, wherein the front end of said hull has a pair of laterally spaced upwardly extending stems, said stems extend forwardly from said front surface, and said cutting edges extend from said front surface into the region of said stems.

13. A ship, as set forth in claim 12, wherein said hull having V-shaped frames spaced rearwardly from the flat planar portion of said front surface and said cutting edges extend rearwardly into the region of said V-shaped frames.

14. A ship, as set forth in claim 13, wherein said cutting edges extend rearwardly in the form of bulge-like lateral reinforcements from said flat planar surface portion of said front surface.

15. A ship, as set forth in claim 1, wherein said skid is formed by V-shaped frames.

16. A ship, as set forth in claim 15, wherein said hull has a bottom located rearwardly from said front surface and said skid extends to said bottom.

17. A ship, as set forth in claim 1, wherein said skid is curved in the elongated direction of the hull.

18. A ship, as set forth in claim 1, wherein said skid comprises teeth.

19. A ship, as set forth in claim 1, wherein said skid has a larger angular inclination relative to the horizontal than said cutting edges.

20. A ship, as set forth in claim 19, wherein the angle of inclination of said skid and said cutting edges decreases in the direction from the front end to the rear end of said hull with respect to the horizontal.

21. A ship, as set forth in claim 1, wherein said pontoon-shaped prow has a transversely extending prow part located in the region of the waterline, said prow part having a plurality of spaced nozzles therein.

22. A ship, as set forth in claim 21, wherein said nozzles are located below the waterline in said prow part.

* * * * *